United States Patent [19]

Cameron

[11] Patent Number: 4,573,933

[45] Date of Patent: Mar. 4, 1986

[54] FLOATING SEARCH AND RESCUE INFLATABLE PYRAMID

[76] Inventor: Robert W. Cameron, #60 Lakeshore Plaza, Suite 1, Kirkland, Wash. 98033

[21] Appl. No.: 506,042

[22] Filed: Jun. 20, 1983

[51] Int. Cl.[4] ..... B63B 21/52

[52] U.S. Cl. ..... 441/16; 441/20; 441/28; 441/30; 441/40; 441/80

[58] Field of Search ..... 441/30, 35–38, 441/40, 1, 6, 11–13, 16–18, 20, 28, 29; 114/345, 346, 348, 349; 343/18 B

[56] References Cited

U.S. PATENT DOCUMENTS

| | | | |
|---|---|---|---|
| 2,854,014 | 9/1958 | Hasselquist | 441/40 |
| 3,155,992 | 11/1964 | Shewmake et al. | 343/18 B |
| 3,229,290 | 1/1966 | Fisher | 343/18 B |
| 3,618,150 | 11/1971 | Anselmi | 441/16 |
| 3,883,913 | 5/1975 | Givens | 441/37 |
| 4,193,057 | 3/1980 | Bennett et al. | 441/11 |
| 4,216,559 | 8/1980 | Snitlik | 441/40 |

FOREIGN PATENT DOCUMENTS

| | | |
|---|---|---|
| 117095 | 3/1930 | Fed. Rep. of Germany . |
| 673417 | 6/1952 | United Kingdom . |
| 1559901 | 1/1980 | United Kingdom . |

OTHER PUBLICATIONS

Wigmore, Dwarfing the Perils of the Sea, Discovery, Apr. 1960, p. 154.

Whiting Co., Catalog 35, Baltimore, MD, Apr. 1982.

*Primary Examiner*—Trygve M. Blix

*Assistant Examiner*—Stephen P. Avila

*Attorney, Agent, or Firm*—Seed and Berry

[57] ABSTRACT

A pyramid constructed of upstanding inflatable beam members extending from an inflatable base upwardly to an apex. The inflatable base carries an integral sea anchor depending therefrom, comprising an inflatable cross tube carrying a depending inflatable anchor tube with an anchor weight positioned in the lowermost portion thereof. The sea anchor has a plurality of flood ports positioned in panels enclosing the vertical anchor tube and weight. Flat panels of flexible sheet material extend between the upstanding inflatable beams to form a pyramidal surface. The panels include an upper radar reflective panel portion, a lower colored panel portion, and a translucent panel portion positioned between the upper and lower panel portions. A solar still mechanism is positioned within the enclosure formed by the pyramidal surface. Pockets are provided for survival gear on the exterior of the pyramidal surface.

8 Claims, 4 Drawing Figures

FIG. 1
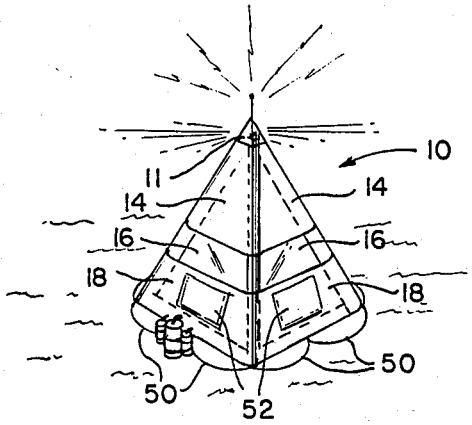
FIG. 3
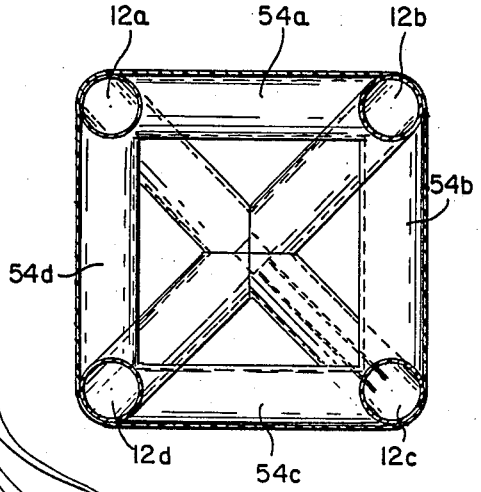
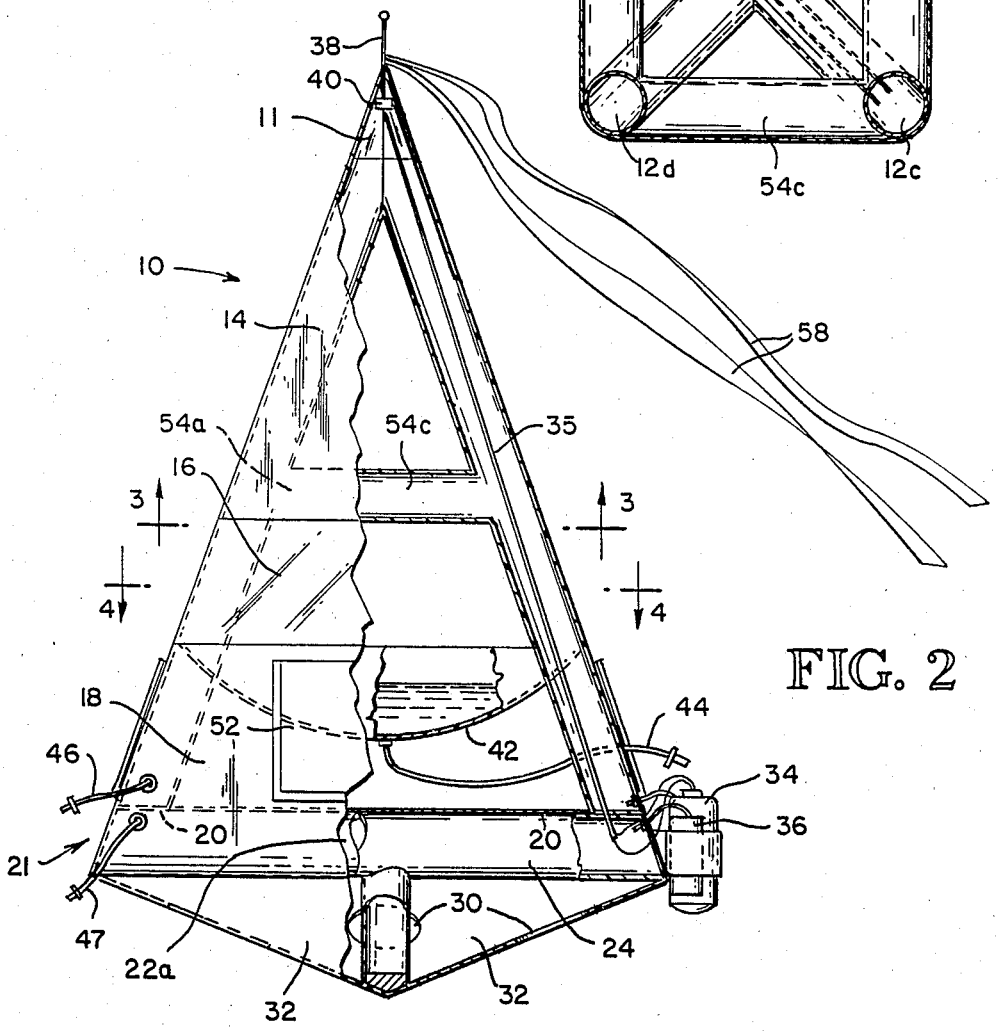
FIG. 2

FLOATING SEARCH AND RESCUE INFLATABLE PYRAMID

BACKGROUND OF THE INVENTION

This invention relates to search and rescue devices particularly useful in marine environments and more particularly relates to a signal mechanism to aid in the search for and rescue of occupants of aircraft, boats or the like which have encountered difficulties in marine areas.

PRIOR ART

It is known to use signaling mechanisms including radio signals, radar reflective devices and brightly colored fabric or plastic panels to aid in locating downed mariners or aviators. Likewise, it is well-known to use visible signals, including strobe lights, flares and the like to attract the attention of ships passing nearby in the event of a disaster at sea. Heretofore most efforts in the search and rescue equipment area have been toward providing a place for the downed mariner or aviator to crawl inside a craft such as an inflatable life raft, which may or may not be equipped with certain types of signaling mechanisms. Prior to the invention described herein an automatically inflatable signaling mechanism having a highly visible structure with survival apparatus contained thereon has not been readily available.

SUMMARY OF THE INVENTION

It is an object of this invention to provide a search and rescue pyramid device which is inflatable automatically upon deployment from a water craft or aircraft and which contains signaling means as well as survival gear to aid the downed aviator or mariner.

It is another object of this invention to provide a search and rescue pyramid inflatable upon deployment which contains a solar still mechanism.

It is further object of this invention to provide a search and rescue pyramid having a integral sea anchor to provide a mechanism which is self-righting and resistant to overturning in wind and waves.

To achieve the foregoing objects an inflatable device having a substantially conical or pyramidal shape is provided with a built in sea anchor. The structure is constructed of a suitably lightweight yet strong and readily formed material which can be fabricated into the desired shape and configuration. Material such as MYLAR, a polyester film produced by E. I. DuPont de Nemours, Wilmington, Delaware, or equivalent polymer sheet material can be used. The apparatus contains a plurality of upstanding inflatable beams, a plurality of intermediate cross beams, a separately inflatable base, together with a depending sea anchor mechanism. The upper and lower portions of the pyramid are separately inflatable by means of a self-contained carbon dioxide inflation system as well as auxillary inflation bibs which may be operated orally by a person in the water adjacent the partically inflated pyramid or cone. The outer surface of the mechanism is adapted at its upper extremity for radar reflectivity by utilizing a MYLAR sheet suitably aluminized. The mid section of the pyramid preferably is covered with a clear plastic sheeting material to permit the operation of an internally disposed solar still. The lower portion of the pyramid is preferably covered with a brightly colored plastic sheet such as rescue orange MYLAR. The sea anchor portion of the mechanism is equipped with a vertical air tube extending downwardly from the center of the pyramid with a lead or other heavy anchor weight disposed in the bottom of the depending air tube. A sheet material formed in a conical or pyramidal shape encloses the vertical air tube and weight and is provided with a plurality of flood ports to permit entry of water into the interior of the device, thus forming an effective sea anchor mechanism. Grasping ropes or rings are provided around the perimiter of the pyramid to permit grasping by a persons in the water adjacent the pyramid. Means for holding a plurality of survival bags or the like are provided on the exterior of the pyramid. The concept of this device precludes entry of a survivor into the inside of the pyramid but anticipates providing survival suits and the like so that a survivor may float or suspend themselves in the water adjacent the pyramid, yet avoid hyperthermia or other exposure problems for a reasonable time until rescue can be effected.

BRIEF DESCRIPTION OF THE DRAWINGS

FIG. 1 is a perspective view of the inflated floating pyramid of this invention.

FIG. 2 is a side elevational view partly cut away showing various elements of this invention.

FIG. 3 is a cross-sectional view taken along line 3—3 of FIG. 2.

DESCRIPTION OF THE PREFERRED EMBODIMENT

Figure 4:
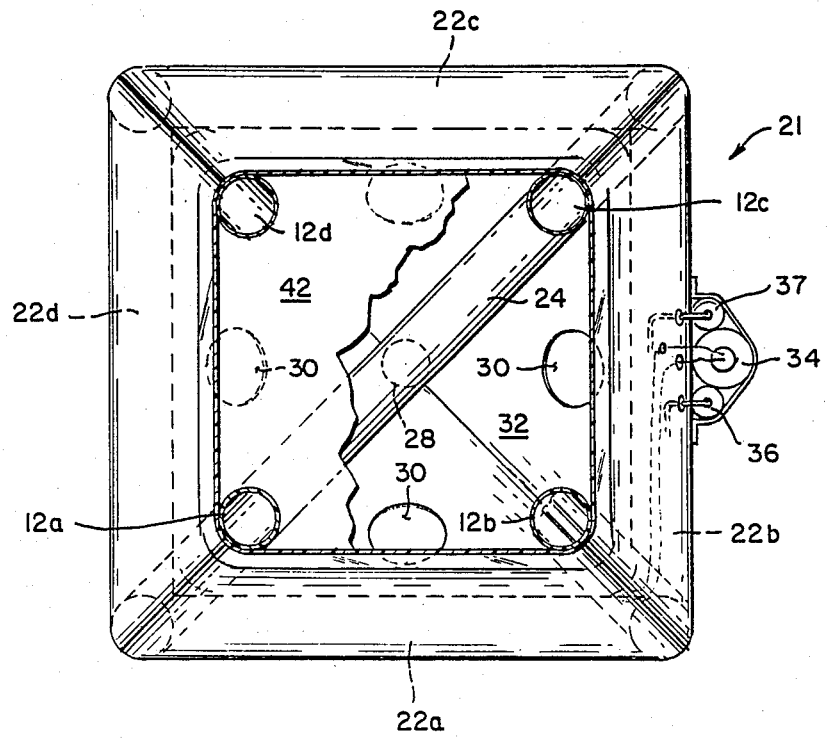
FIG. 4 is a cross-sectional view taken along line 4—4 of FIG. 2.

Referring specifically to the drawings wherein like numerals indicate like parts, there is seen one preferred embodiment of the invention which constitutes the inventor's presently preferred embodiment and best mode. The device shown in the drawings generally comprises a floating pyramid used in the search and rescue arts. Specifically, the invention comprises a plurality of inflatable upstanding beams 12(*a*), 12(*b*), 12(*c*) and 12(*d*) extending upwardly from a base formed of a comparable plurality of base tubes 22(*a*), 22(*b*), 22(*c*) and 22(*d*) which form a rectangular base. The upstanding tubes 12(*a*), 12(*b*), 12(*c*) and 12(*d*) meet at an apex shown generally at 11 and are connected together at apex 11 with air communication among the four tubes shown. Intermediate the apex 11 and base 22 there are four horizontally disposed mid-level inflatable beams 54(*a*), 54(*b*), 54(*c*) and 54(*d*), which provide additional structural rigidity to the pyramid form. Upstanding beams 12(*a*), 12(*b*), 12(*c*) and 12(*d*) are connected to but pneumatically sealed from the based beams 22(*a*), 22(*b*), 22(*c*) and 22(*d*) by a seal wall 20 positioned at the lower end of each of said upstanding inflatable beams. The seal wall 20 serves to isolate the base 22 from the upstanding beams 12(*a*), 12(*b*), 12(*c*) and 12(*d*) to give two separate air chambers as is further described below.

As is best seen in FIG. 4 which is a plan view in cross-section taken along lines 4—4 of FIG. 2, there is a cross tube 24 extending diagonally across the base formed by tubes 22(*a*), 22(*b*), 22(*c*) and 22(*d*). Cross tube 24 pneumatically communicates with the base 21 and is inflated simultaneously with the foregoing base tubes and is positioned as shown to provide a mounting location for anchor tube 28. In FIG. 2 anchor tube 28 is shown extending downwardly from cross tube 24 with an anchor weight 26 positioned at the bottom most portion thereof. The anchor tube 28 together with panels 32 constitute a sea anchor which may be flooded through sea anchor flood ports 30. Having anchor weight 26 positioned as shown causes the device to be self righting under most circumstances when inflated.

The search and rescue pyramid is equipped with a dual inflation system as is best shown in FIG. 4. $CO_2$ supply cartridges 36 and 37 are provided to inflate the upper and lower portions of the apparatus upon deployment. The cylinders are sized so that the volume of carbon dioxide necessary to fully inflate both the upper and lower inflatable portions of the apparatus is provided. Auxillary inflation means are also provided to enable a person in the water to further inflate the apparatus via oral inflation tube 46 provided for the upper section and oral inflation tube 47 provided for the lower segment of the device. By this mechanism additional inflation can be provided as necessary.

The pyramid structure may be equipped with numerous signaling and safety devices. An emergeny radio system which is activated automatically upon deployment may be used as is shown at numeral 34 in the drawings. For example, a model RLB-14 ACR EPIRB radio having a range of 200 to 300 miles operating in a frequency of 121.5 mhz and 243.0 mhz broadcasting a variable audio sweep from 1300 to 300 hz in accordance with RTCA may be used. A magnesium battery pack with a storage life of six years is preferably supplied although other power sources well-known in the art may be utilized. The radio broadcasts through antenna 38 positioned at the top of the pyramid and is connected to radio 34 via antenna wire 35.

In addition, a strobe light 40 positioned in a clear pyramidal section of the top of the pyramid 43 permits the transmission of a strobe such as ACR/SM-2 U.S. Coast Guard approved strobe 160.0101610 high intensity xenon strobe 360 degrees with a life of up to 50 hours. The strobe is similarly activated upon deployment with well-known mechanism.

Radar reflective MYLAR streamers 58 may conveniently be attached to the peak of pyramid 10. Aluminized MYLAR is an effective radar reflective material.

The upper portion of the pyramid, save the clear pyramidal section 11, is covered with a radar reflective MYLAR or equivalent material for form reflective panels 14. The mid-section of the pyramid is covered with a translucent material to form translucent panels 16 for a purpose described further below. The lower portion of the pyramid is covered with colored panels 18, such as the widely used international orange or similar highly visible coloring.

Positioned within the interior of the pyramid is a solar still mechanism, including collector 42 and water withdrawal tube 44. The clear panel 16 permits energy from the sun to operate a solar still in a well-known fashion.

Provision is made for a person in the water to hang on to the inflated floating pyramid by means of safety ropes 50 which are attached at strategic locations around the perimeter of the floating pyramid at or near the water line. These ropes can be used to cling to the device or can be placed beneath the arms of a person floating in the water to provide support and protection to the individual. Protective devices such as inflatable survival suits or the like may be contained in pockets 52 positioned at strategic locations around the exterior of the inflated pyramid. Other appropriate survival gear may similarly be located on or in the pyramid structure.

OPERATION OF THE INVENTION

The apparatus described above is normally stowed folded in a container on an aircraft or boat. Whenever the mechanism is needed, for example upon a crash of an airplane or the sinking of a water craft, the search and rescue pyramid can be deployed by opening the container for the folded device and activating the automatic inflation mechanism of the $CO_2$ supply cartridges for the upper and lower portions of the pyramid. Automatically operational devices analogous to the well-known mechanisms for deploying life rafts can be utilized if desired. At the time of deployment the radio 34 and the strobe light 40 would be activated. The inflatable beams namely 12(*a*), 12(*b*), 12(*c*) and 12(*d*) together with the base inflatable structure 22(*a*), 22(*b*), 22(*c*) and 22(*d*) would be automatically inflated by the carbon dioxide supply cartridges 36 and 37 respectively. Due to the presence of the anchor weight 36 the device would immediately assume an upright position as shown in FIG. 1 and the bottom of the mechanism would become a sea anchor flooded through ports 30. Due to the shape of the pyramid, high winds would have a lesser effect on the device than other shapes. As wind blows against one of the triangular side segments the pyramid would merely bend and dump the wind much in the manner of a sail being luffed.

In compliance with the patent statutes, the invention has been described in language more or less specific as to structural features. It is to be understood, however, that the invention is not limited to the specific features shown, since the means and construction herein disclosed comprise only a presently preferred form of putting the invention into effect. The invention is, therefore, claimed in any of its forms or modifications within the legitimate and valid scope of the appended claims, approximately interpreted in accordance with the doctrine of equivalents.

I claim:

1. A pyramid-shaped floating search and rescue inflatable signal and safety mechanism, comprising:

an inflatable base comprising a plurality of horizontally disposed base tubes, and a centrally positioned depending inflatable anchor tube extending downwardly and containing a weight;

a plurality of inflatable beams extending upwardly from the base to an apex;

flat panels of flexible sheet material extending between said inflatable beams to form a first pyramidal surface, said panels including an upper radar reflective panel portion, a lower colored panel portion, and a translucent panel portion positioned between said upper and lower panel portions;

a solar still mechanism positioned within the enclosure formed by said first pyramidal surface; and flexible sea anchor panels stretched from said base tubes to the lowermost end of said inflatable anchor tube, said sea anchor panels having flood ports therein for restricted entry and exit of water and forming a second, depending pyramidal surface.

2. The apparatus of claim 1 wherein said base is rectangular and contains a diagonally positioned cross tube.

3. The apparatus of claim 1 further including mid-level inflatable beams extending between said upstanding inflatable beams.

4. The apparatus of claim 1 wherein said apex includes radio transmitting and strobe light means.

5. The apparatus of claim 1 wherein auxillary inflation means are provided for inflation of the device orally by the user.

6. The apparatus of claim 1 further including radar reflective streamers attached to and extending from said apex.

7. The apparatus of claim 1 further including grasping ropes or rings around the perimeter of the base of said mechanism for grasping by a person in the water.

8. The apparatus of claim 1 and pockets for survival gear on the exterior of said first pyramidal surface.

* * * * *